United States Patent [19]

Verhoef

[11] Patent Number: 4,614,511

[45] Date of Patent: Sep. 30, 1986

[54] APPARATUS FOR FOLDING A BOX OR TROUGH FROM A BLANK

[76] Inventor: Willem L. Verhoef, Dorpstraat 5, 4111 KR Zoelmond, Netherlands

[21] Appl. No.: 708,952

[22] Filed: Mar. 6, 1985

[30] Foreign Application Priority Data

Mar. 16, 1984 [NL] Netherlands ..... 8400856

[51] Int. Cl.[4] ..... B31B 3/02

[52] U.S. Cl. ..... 493/125; 53/207; 493/167; 493/313

[58] Field of Search ..... 493/313, 316, 125, 124, 493/123, 162, 167; 53/207, 209, 574

[56] References Cited

U.S. PATENT DOCUMENTS

| | | | |
|---|---|---|---|
| 2,723,603 | 11/1955 | Chandler | 93/52 |
| 2,743,651 | 5/1956 | Wilcox | 93/51 |
| 2,820,403 | 1/1958 | Plough et al. | 93/51 |
| 3,046,849 | 7/1962 | Bowman | 93/51 |
| 3,065,679 | 11/1962 | Clement | 93/51 |
| 3,218,940 | 11/1965 | Pearson | 93/51 |
| 3,533,333 | 10/1970 | McIntyre | 493/313 X |
| 3,543,469 | 12/1970 | Ullman | 493/162 X |
| 4,149,452 | 4/1979 | Talarico | 493/162 |
| 4,206,691 | 6/1980 | Lines | 493/162 |

FOREIGN PATENT DOCUMENTS

| | | |
|---|---|---|
| 2106465 | 8/1971 | Fed. Rep. of Germany . |
| 2008313 | 9/1971 | Fed. Rep. of Germany . |

*Primary Examiner*—James F. Coan

*Attorney, Agent, or Firm*—John P. Snyder

[57] ABSTRACT

Apparatus is provided for folding a box or trough from a preformed blank of cardboard, corrugated cardboard, duplex cardboard, coated paper, synthetic material, wood such as plywood or multiply, or other sheet or plate material, the blank being provided in advance with folding seams and consisting at least of a portion for the bottom and portions separated therefrom by such folding seams for the upright walls of the box or trough to be folded, the apparatus including means for holding the blank in a predetermined position, a first conveyor for moving the blank transversely to its plane from said position, a mould provided in the path of the conveyor and having a mould cavity which is surrounded by a set of folding members and has a bottom area extending transversely to said path and corresponding to the bottom portion of the box or trough to be folded, stops projecting into said bottom area and adapted to arrest the movement of said bottom portion and also a second conveyor for removing the blank folded in the mould out of the latter.

15 Claims, 7 Drawing Figures

APPARATUS FOR FOLDING A BOX OR TROUGH FROM A BLANK

Figure 1:
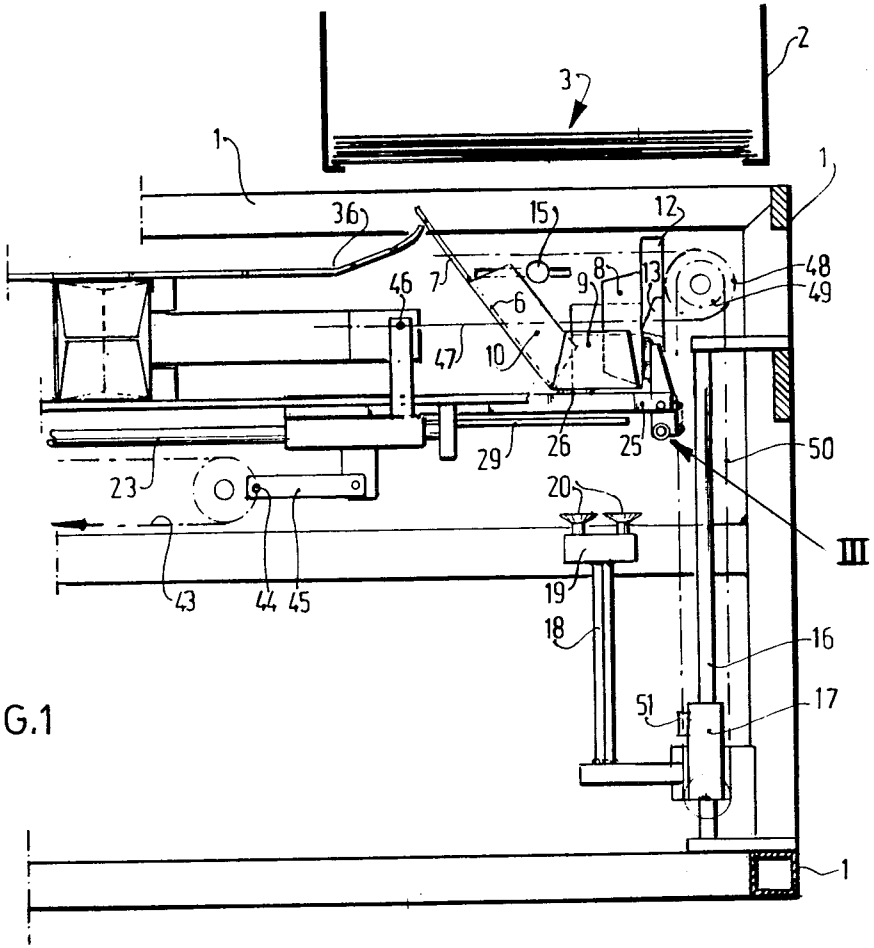

The invention relates to an apparatus for folding a box or trough from a preformed blank of cardboard, corrugated cardboard, duplex cardboard, coated paper, synthetic material, wood such as plywood or multiply, or other sheet or plate material, said blank being provided in advance with folding seams and consisting at least of a portion for the bottom and portions separated therefrom by such folding seams for the upright walls of the box or trough to be folded, said apparatus comprising at least means for holding the blank in a predetermined position, a first conveyor for moving the blank transversely to its plane from said position, a mould provided in the path of said conveyor and having a mould cavity which is surrounded by a set of folding members and has a bottom area extending transversely to said path and corresponding to the bottom portion of the box or trough to be folded, stops projecting into said bottom area and adapted to arrest the movement of said bottom portion and also a second conveyor for removing the blank folded in the mould out of the latter.

In known apparatuses of this kind the blanks are pushed one after the other into the mould by a mandrel mounted for up and down or to and fro reciprocation. This has the disadvantage that in the first place it is not possible to provide straight above or next to the mould a magazine for a stack of blanks, which would make it possible to simplify the construction of the apparatus, secondly it would make things difficult to dispose onto the blank, the load for the box or trough before the blank has been folded, since then said load has to be able to take up the pressure of the mandrel, which would mostly be impossible if, for instance, said load should consist of limp bags filled with food and thirdly that the speed of the apparatus will be relatively slow.

The invention has for its object to provide an apparatus of the kind referred to here-above, in which the said disadvantages of the known apparatuses are avoided as much as possible. According to the invention this is achieved, in that the first conveyor includes at least one supporting member mounted for reciprocation between two end positions and having a suction head attached thereto adapted to be moved through the bottom plane of the mould cavity and provided with suction openings or cups fitted for connection to a suction conduit, said suction head being adapted, during operation, to engage the blank held in the predetermined position on the lower side of its portion meant for the bottom of the box or trough and to pull, during its active stroke, the blank past said set of folding members into the cavity of the mould. In this apparatus a next blank, when either being contained in a magazine or lying on or between supporting members, can already be positioned in a place above or next to the mould and be ready to be engaged by the first conveyor, when the folding of the preceding blank is still going on. Waiting for the moment that the mandrel has left said place is then unnecessary. Thereby the speed of the apparatus can be considerably increased.

The most simple apparatus is obtained, when the means for holding the blank in a predetermined position include a magazine for a stack of blanks, said magazine being so arranged and constructed, as to enable, during operation, the suction head of the first conveyor to pull each time the lowermost blank of said stack or each time the end blank of the stack which faces with its lower side to the outside out of the magazine and to carry it to the mould.

An other apparatus may advantageously be constructed so that the means for holding the blank in a predetermined position include two parallel composite guide bars meant for guiding the blank from a place out of the reach to a place defining said predetermined position within the reach of the first conveyor, said guide bars holding the blank at least in the latter place at two opposite edges and supporting it on its lower side in narrow margins or parts thereof adjacent to said edges. This apparatus has the advantage that on the blank lying in its place above the first conveyor the filling for the box or trough may be disposed before the folding process starts. Furthermore, this apparatus may comprise a magazine for blanks, a third conveyor mounted for reciprocation between two end positions, said third conveyor comprising at least one suction head for engaging the lower side of the blank and moving same in a direction transverse to its plane to the guide bars, and a fourth conveyor provided with a carrier member for moving the blank along said guide bars to the place within the reach of the first conveyor.

In the described apparatuses the second conveyor may be so mounted for reciprocation between two end positions, as to remove, during its active stroke, from the mould, the part of the box or trough folded in the mould and extending with its bottom in a plane containing the bottom area of the mould cavity, whereas a second set of folding members for folding the portions of the blank still to be folded after the blank has passed the mould may be provided on both sides and, if necessary, above the path of the second conveyor. Advantageously, the second conveyor may then comprise at least one suction member which engages, in the position at the beginning of the active stroke of said conveyor, the bottom of the folded part of the box or trough contained in the mould on its lower side near the bottom edge which is leading in the direction of said stroke, said suction member holding said bottom till the folding operation of the second set of folding members has been completed. This holding of the bottom of the box or trough in the place thereof referred to is favourable for the folding of the blank parts. In order to have the transport of said second conveyor carried out reliably, it is recommended to provide the second conveyor also with a carrier member which is adapted to be put, at the beginning of the active stroke of said conveyor, into an active position behind the upright and, seen in the direction of said stroke, rear wall of the folded part of the box or trough contained in the mould but, during the inactive stroke of said conveyor, into an inactive position. This carrier member may also be used to push the boxes or troughs which have been previously folded in the apparatus out of the apparatus.

In order to simplify as much as possible the adjustment of the apparatus to the dimensions of the boxes or troughs to be folded it will be advantageous, when at least the set of folding members surrounding the mould cavity as well as the set of folding members on both sides and, if necessary, above the path of the second conveyor consists of two groups, of which one group is attached to a stationary part and the other group is attached to an adjustable part of the apparatus, said latter part being adjustable in a direction parallel to the plane of the path of the second conveyor and transversely to the direction of movement thereof. For the same purpose one guide bar with its portion for guiding and supporting the blank at an edge thereof may be attached to a stationary part and the other guide bar with its portion for guiding and supporting the blank at an other edge thereof may be attached to an adjustable part of the apparatus, said latter part being adjustable in a direction parallel to the plane of the path bordered by the two guide bars and transversely to said bars.

For driving the first conveyor the latter may be connected to an endless chain mounted for reciprocation between two end positions and coupled directly or indirectly through a transmission mechanism with one end of a link, of which the other end is pivotally connected with a point of an other endless chain, which is driven by a motor in one direction. Also the second conveyor may be coupled directly or indirectly through a transmission mechanism with one end of a link, of which the other end is pivotally conneted with a point of an endless chain which is driven by a motor in one direction. The fourth conveyor may comprise at least one endless chain mounted for reciprocation between two end positions and provided with a carrier member, said chain being coupled with one end of a link, of which the other end is pivotally connected with a point of an endless chain which is driven by a motor in one direction. The first, the second and the fourth conveyor may for their driving all be coupled through the same link with the chain which is driven by the motor in one direction.

Advantageously, the third conveyor may be mounted for swinging about an axis which is parallel to the plane of the path of the fourth conveyor and extends transversely to the direction of movement thereof, and said third conveyor may be adapted to be driven to and fro between its end positions by catches attached thereto and carrier members cooperating with said catches and associated with a reciprocating chain adapted to drive the fourth conveyor or associated with the or a chain of the latter.

The apparatus constructed according to the invention can be easily extended by means for diposing in advance articles to fill the box or trough to be formed on the bottom portion of the blank held in the said predetermined place. For that purpose said means may comprise at least a loading platform or an endless conveyor belt for supporting or feeding, respectively, on the right level groups of articles arranged in a given formation, a chain mounted for reciprocation between two end positions and provided with a carrier member for pushing said formation of articles from said platform or said conveyor belt onto said blank bottom portion and a coupling gear provided between said chain and the chain connected to the first conveyor, said gear having a transmission ratio which depends on the number of layers of articles to be packed in the box or trough.

Figure 2:
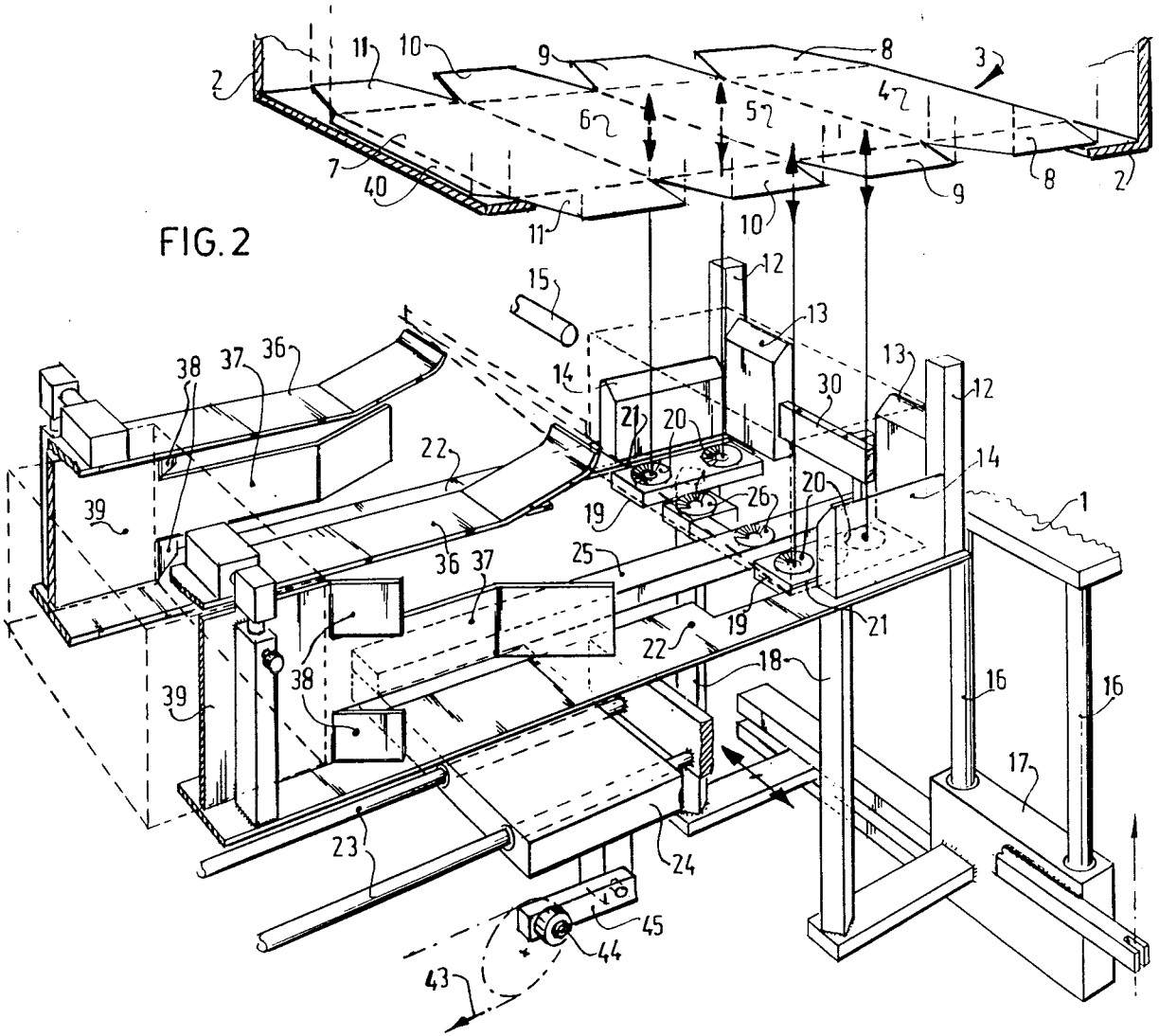
Figure 3:
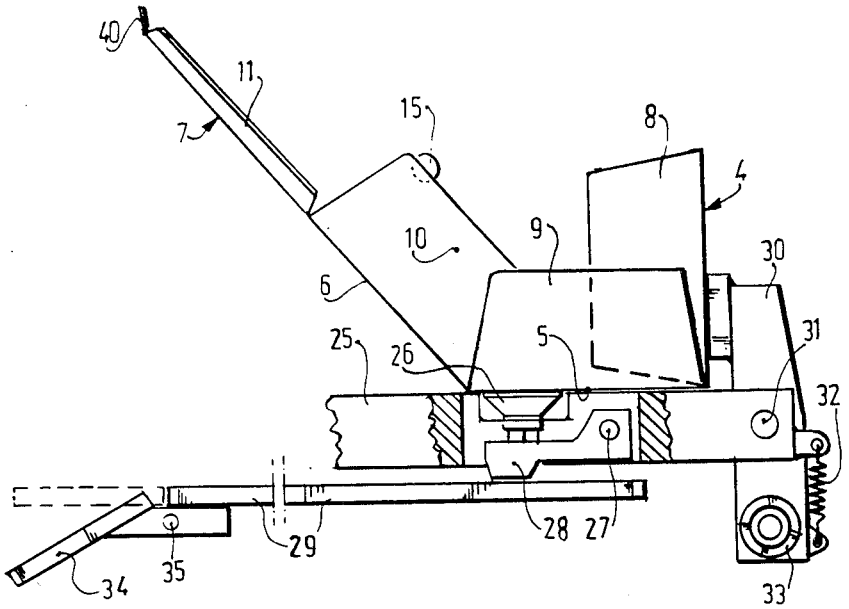
Figure 4:
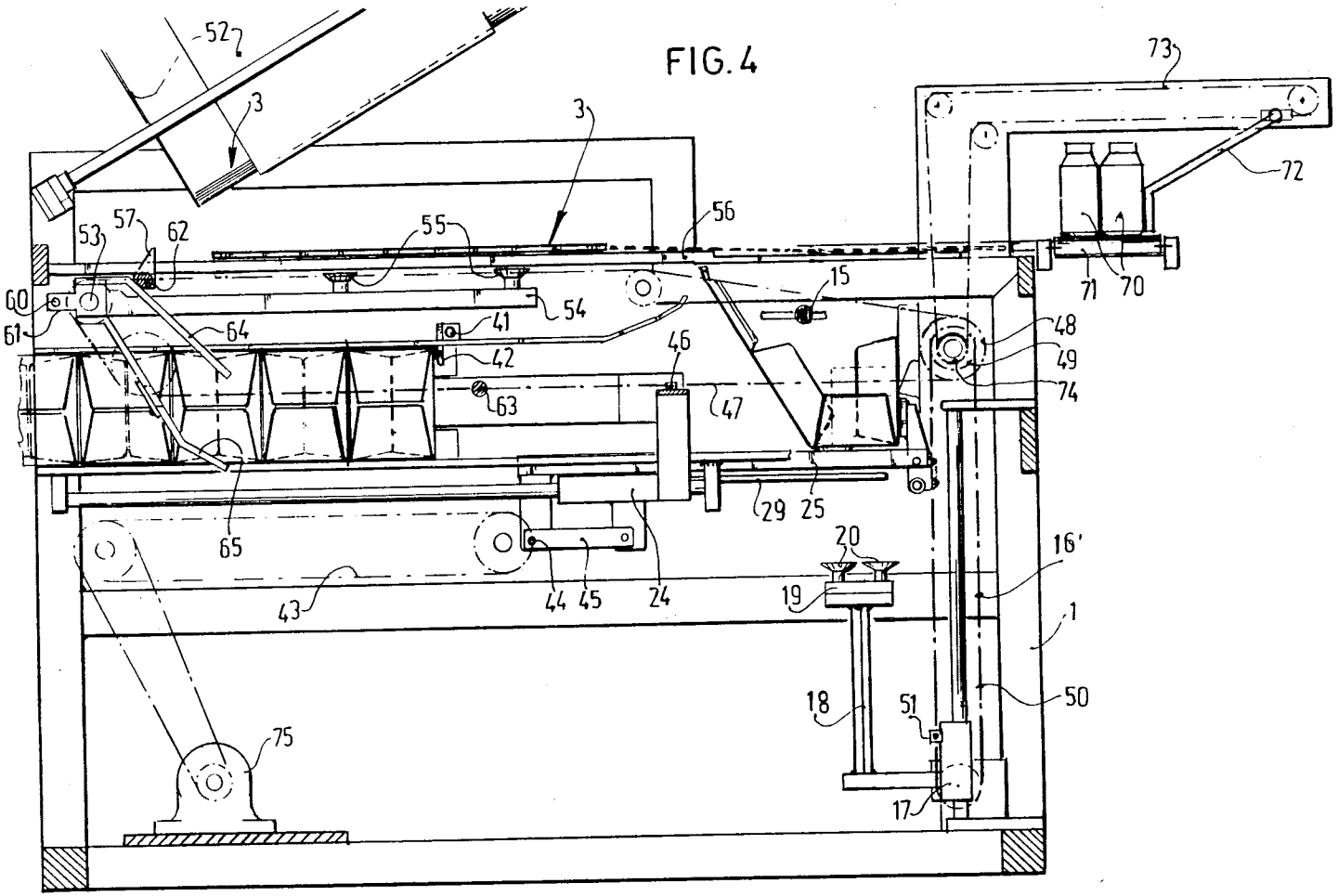
Figure 5:
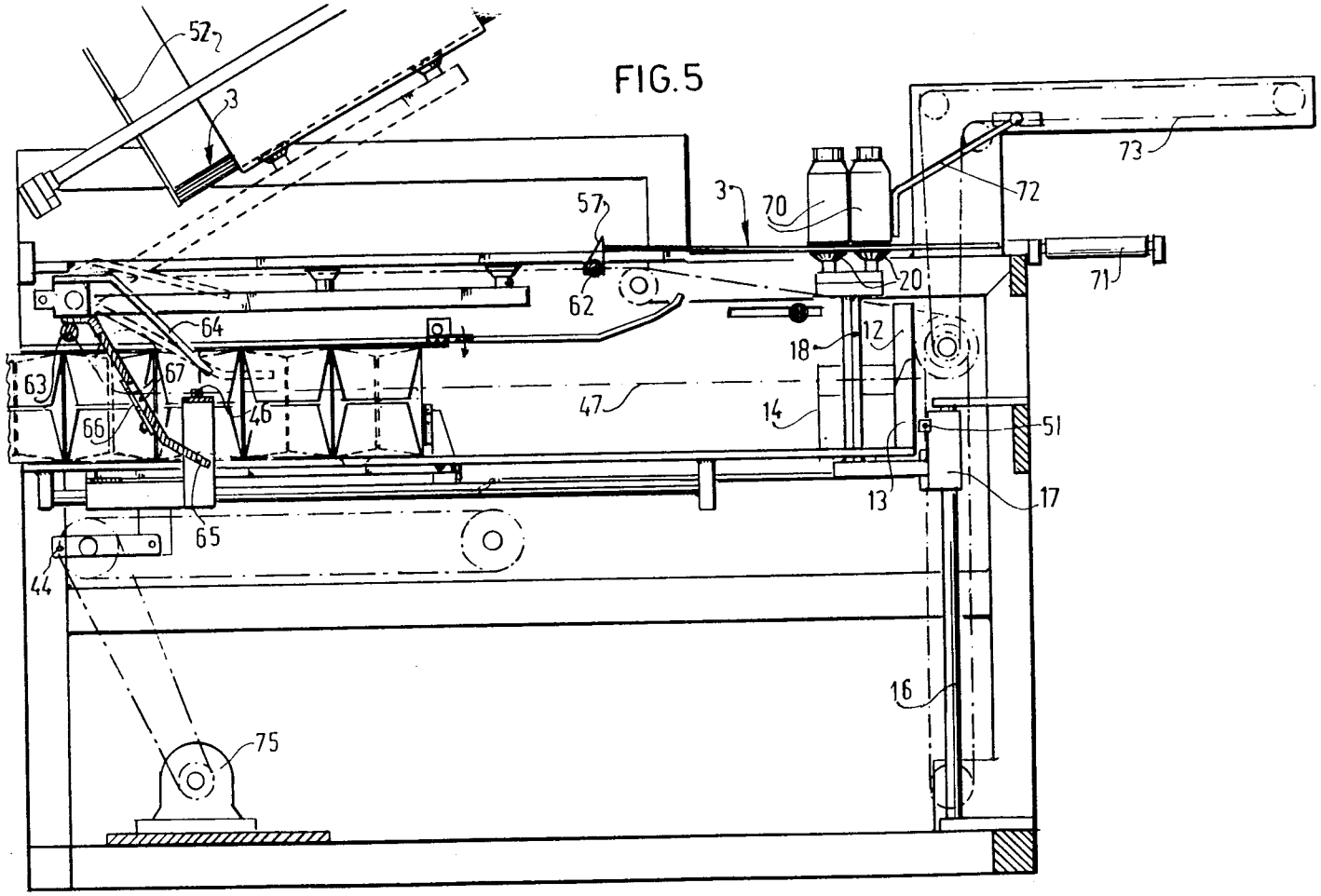
Figure 6:
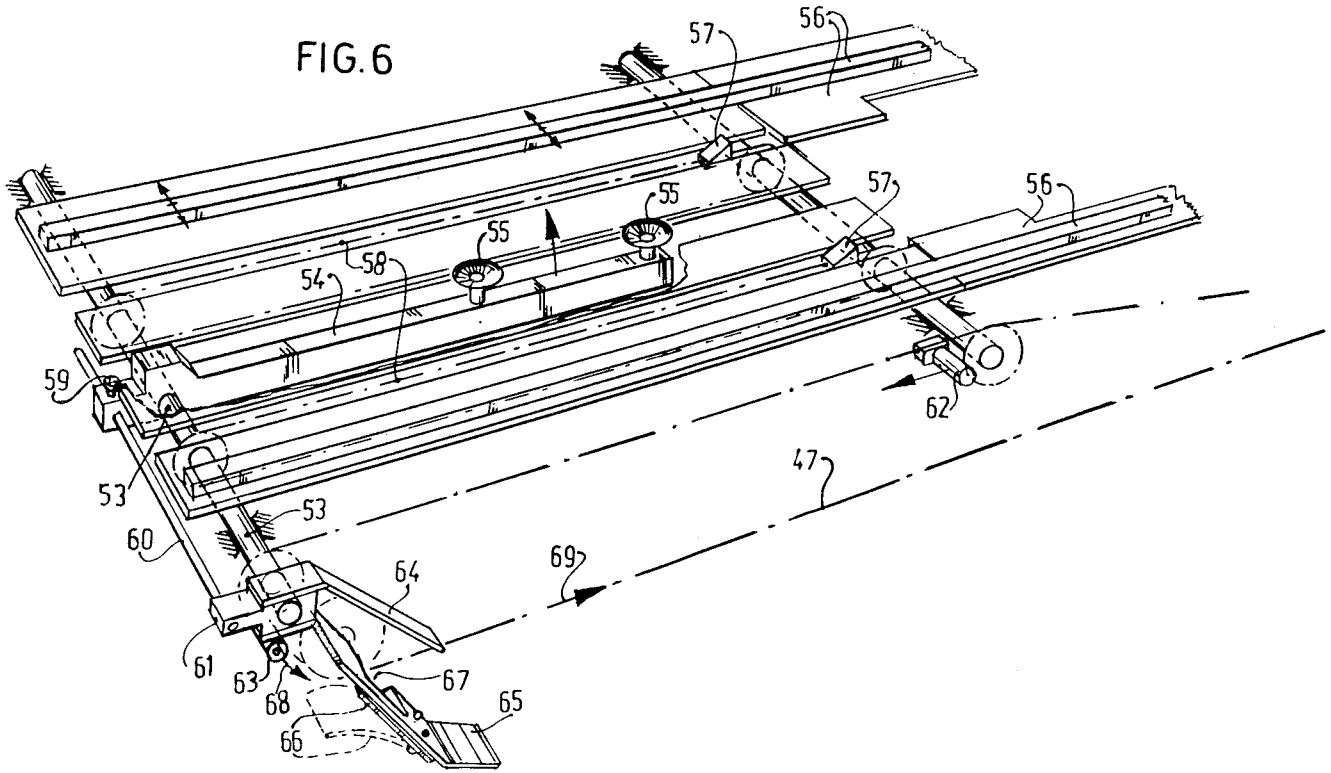
Figure 7:
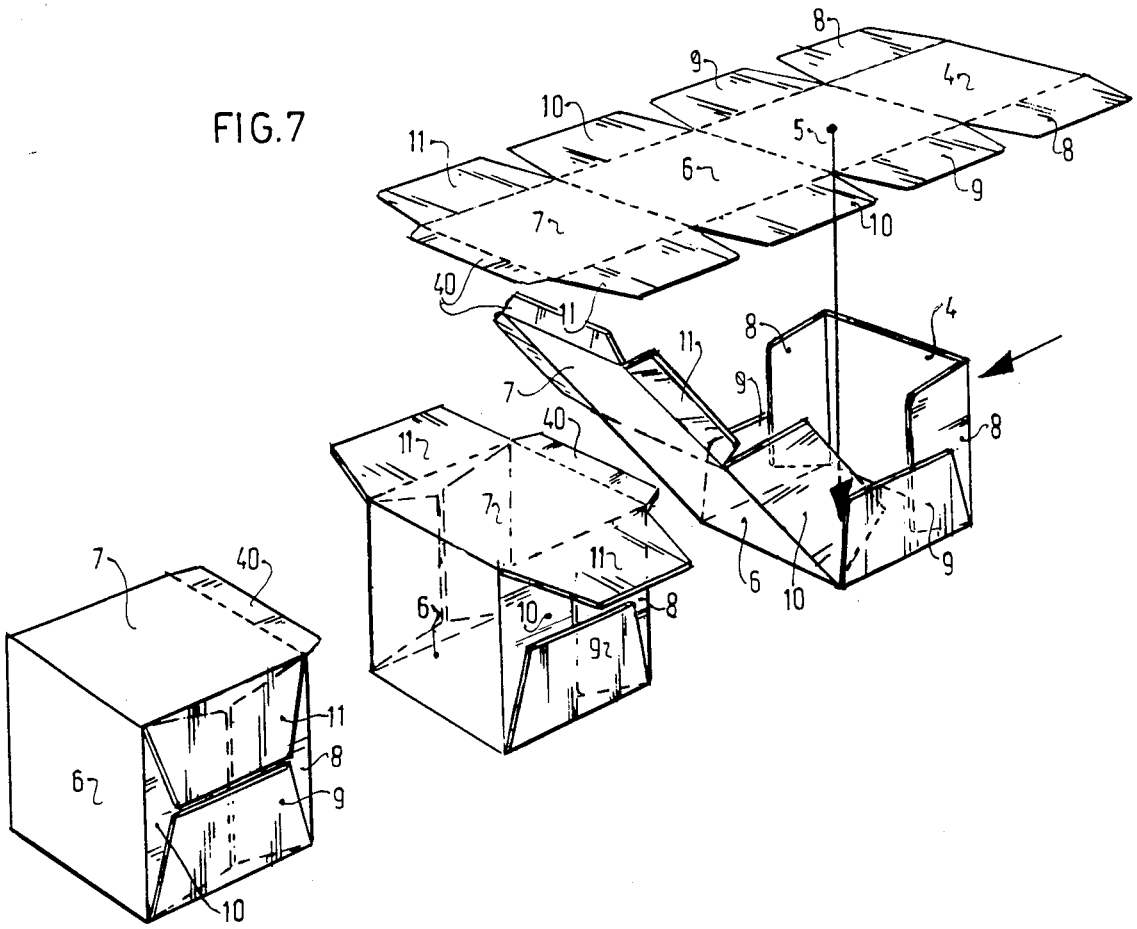

The invention will be further elucidated with the aid of the drawing. In the drawing:

FIG. 1 is partially an elevational view and partially a vertical sectional view of the directly understandable essential part of a first embodiment of the apparatus for folding boxes or troughs in accordance with the invention, FIG. 2 is a perspective view of the part of the first embodiment of the apparatus shown in FIG. 1, FIG. 3 is on a lager scale a detail of the apparatus shown in FIGS. 1 and 2, FIG. 4 is partially an elevational view and partially a vertical sectional view of a second embodiment of the apparatus according to the invention in a given state, FIG. 5 is an elevational view and a vertical sectional view of the apparatus shown in FIG. 4 in an other state, FIG. 6 is a perspective view of a detail of the apparatus illustrated in FIGS. 4 and 5 and FIG. 7 is a perspective view of different stages of folding a blank into a box closed by a cover wall.

In FIGS. 1, 2 and 3 beams and bars of a stationary frame of a first embodiment of the apparatus are designated by 1. Although from FIG. 2 it may be deduced that FIG. 1 shows a vertical elevational view of said apparatus, it is observed that the apparatus can also be used in another position, say in a position in which FIG. 1 shows a horizontal, e.g. a top view. For the sake of simplicity the apparatus will be described when in a position, in which FIG. 1 shows a vertical elevational view.

Above the frame 1 there is a magazine 2 with a stack of preformed blanks 3 of sheet- or plate-shaped material said blanks being provided in advance with folding seams. The shape of the blanks appears from FIG. 2. In the present case each blank consists of portions 4, 5, 6, 7 respectively meant for the upright front wall, the bottom, the upright rear wall and the cover wall of the box to be folded and also, connected with the said portions, of portions 8, 9, 10, 11 for the upright side walls.

If the cover wall portion 7 and the adjacent side wall portions 11 of the described blank should be omitted, a trough could be folded from the remaining parts of said blank.

Vertically beneath the bottom portion 5 of the blanks contained in the magazine 2 there is a composite mould, the forming cavity of which is surrounded by two horizontally opposite equal sets of folding members 12, 13, 14, 15. For the sake of clarity only one of the folding members has been shown.

According to the invention the lowermost blank of the stack contained in the magazine is each time removed from the magazine and pulled into the mould cavity of the mould by means of a composite first conveyor including two vertical bars 18 which carry each at their top ends a suction head 19 provided with suction cups 20 and adapted to be connected to a suction pipe (not shown) and are attached to a block 17 which is mounted for reciprocation along stationary vertical guide rods 16. The suction heads 19 engage said blank on the lower side of the bottom portion 5 thereof and the mould cavity has a bottom area which corresponds with said bottom portion. With the lower side of the blank is meant the side, which forms after the folding operation the outer surface of the box or trough.

In the path of the blank towards the mould first the side wall portions 8 and 10 thereof meet the far upwardly pointing folding members 12 and the high level folding members 15, whereby said side wall portions are set substantially upright in respect of the front wall portion 4 and the rear wall portion 6. At the same time the rear wall portion 6 and the cover wall portion 7 and the side wall portions 10 and 11 are bent upwards and set at an angle between 45° and 90° with the bottom portion 5 by the free ends of folding fingers 36 which will be discussed hereinafter. Thereafter the front wall portion 4 with its already set side wall portions 8 is set upright by the less far upwardly pointing folding members 13 and a little later the side wall portions 9 are bent upright by the still lower folding members 14.

If thereupon the partially folded box comes to rest on narrow stop strips 21 (FIG. 2) extending in the bottom area of the mould cavity, the suction heads 19 with the suction cups 20 are disconnected from the suction pipe (not indicated) and the first conveyor is moved with its suction cups 20 further downwardly, so that the box comes to lie loosely in the mould. The stop strips 21 form part of two horizontal supporting strips 22 which extend in a direction at right angles with the direction of movement of the first conveyor and serve to guide the box, when the latter is removed from the mould by a horizontally reciprocatable second conveyor. This second conveyor guarantees that the partly folded box has been removed from the mould, before the first conveyor is again raised through the bottom area of the mould to pull a next blank out of the magazine.

The second conveyor comprises a block 24 mounted for reciprocation along stationary horizontal guide rods 23 and carrying a bar 25 provided with two suction cups 26 which are adapted to be connected to a suction conduit (not shown). It appears from FIG. 3 that the suction cups 26 are supported by an arm 28 which is swingably mounted on a shaft 27 and is held, during a portion of the active stroke (to the left) at the beginning thereof and during a portion of the inactive stroke (to the right) at the end thereof, up by a guide strip 29 not illustrated in FIG. 2 but in FIG. 3 to such an extent that the suction cups 26 are adapted to engage a box contained in the mould on the lower side of its bottom 5 and to continue to hold the box through the length of the mentioned portion at the beginning and at the end of the to and fro stroke, respectively, of the bar 25. The transport of the box out of the mould and along the supporting strips 22 is effected by a carrier member 30 provided at the end of the bar 25 and mounted for swinging about an axis 31. Said carrier member 30 is forced by a spring 32 into the active position shown in FIG. 3 and held, during said transport, in said position by a roller 33 engaging the lower side of the guide strip 29.

The left end portion 34 of the stationary guide strip 29 is adapted to tumble about an axis 35 and acts as a switch for the roller 33 of the carrier member 30 (FIG. 3). If, near the end of the active stroke of the bar 25, the roller 33 contacts the lower side of the left end portion 34 of the guide strip 29, said end portion is swung up by the roller 33, so that it forms an extension of the guide strip 29 and the roller 33 is permitted to pass under said end portion. As soon as said end portion 34 has been left by the roller 33, the portion 34 tumbles down again, that means into the oblique position shown in FIG. 3, so that, during the inactive stroke of the bar 25 (to the right), the roller 33 runs up the end portion 34 and comes to roll on the upper side of the guide strip 29. The carrier member 30 is then swung in the horizontal position, so that, when moved during said stroke to its right-hand end position, it can pass under a next box arrived in the meantime in the mould cavity, without contacting said box. As soon as the roller 33 has left the right-hand end of the guide strip 29, the carrier member is swung again by the spring 32 into the active position shown in FIG. 3.

Attention is drawn to the fact that the suction cups 26 engage the bottom of the box near the edge between the bottom and the upright rear wall 6. The object thereof is to keep the bottom of the box flat, consequently, to keep said edge pressed on the supporting strips, when the rear wall portion 6 and the cover wall 7 together with its side wall portions 11 are folded during the horizontal transport of the box out of the mould.

For this latter folding operation there are provided above and by the side of the path of the second conveyor 24, 25, 26, 30 two folding fingers 36 for folding the cover wall 7, two folding fingers 37 for folding the side wall portions 10 and four folding fingers 38 with folding bosses (not shown) acting on the side wall portions 9 and 11. These folding bosses fold the side wall portions 11 so far down and the side wall portions 9 which often are not folded in a sufficiently sharp-edged way by the folding members 14 of the mould so far up, as to ensure that said portions 11 and 9 are engaged by the folding fingers 38 and bent exactly square before being introduced between guide walls 39. As a result thereof the portions 8, 9, 10 and 11 of the side walls are pressed well one against the other and bonded to one another in the places, where they are provided in advance with glue. In certain cases the protruding folding fingers 37 may be omitted and form each together with a set of two folding fingers 38 an outwardly bent catch plate. Glue is applied on the respective side wall portions by means of glue-guns, licking devices or other glue applying devices, which are omitted in the drawing for the sake of clarity.

After the box has been folded and glued it has reached a position, in which the suction cups 26 are disconnected from the suction conduit and the tumbling arm 28 with said suction cups has left the guide strip 29, so that the suction cups have gone down a little and freed themselves from the bottom of the box.

On its path out of the apparatus the just folded and glued box bumps up against the row of earlier completed boxes, so that said row of boxes is pushed further out of the apparatus, for instance towards a conveyor belt for the following transport of said boxes.

It also deserves to be mentioned that in the present case a marginal portion 40 is provided on the cover wall portion, said marginal portion being folded over and glued to the front wall portion 4 by means of a folding plate 42 which for instance may be pneumatically tilted about an axis 41.

It will be obvious that, only when the box, during the folding of the blank, has been filled with articles to be packed, the cover wall 7 together with the adjacent side wall portions 11 and the marginal portion 40 may be glued to the upright walls of the box in the described apparatus. Should the box not be filled in the apparatus, the filling and closing of the box will have to occur in places outside the box.

The first and the second conveyor of the apparatus illustrated in FIGS. 1, 2 and 3 are driven synchronously by means of an endless chain 43 driven by a motor 75 (not shown in FIGS. 1, 2 and 3; see FIGS. 4, 5) and connected pivotally in a point 44 with one end of a link 45, of which the other end is pivotally secured to the block 24 of the second conveyor. If the chain 43 is driven in one direction, the second conveyor reciprocates between two end positions. The block 24 is also connected with the point 46 of a second endless chain 47 which is coupled with a third endless chain 50 through sprocket wheels 48 and 49. This third chain is attached in the point 51 to the block 17 of the first conveyor. Due to this coupling of the two conveyors the suction head 19 with its suction cups 20 will be moved upwardly to draw a blank 3 from the magazine 2, when the second conveyor moves to the left to remove a partially folded box out of the mould to complete the folding thereof during the rest of the horizontal transport and to discharge it, and vice versa.

The apparatus illustrated in FIGS. 4, 5 and 6 differs mainly from the one shown in FIGS. 1, 2 and 3 in that the magazine 52 containing the blanks 3 is not positioned straight above the first conveyor 17, 18, 19, 20 but is found at some distance to the left from the place above said conveyor and a third conveyor 54 with suction cups 55 connected to a suction conduit is provided which is mounted for swinging about an axis 53, is adapted to engage each time the lowermost blank of the stack contained in the magazine on the lower side thereof and to place said blank onto two composite horizontal guide bars 56 for supporting the blank at two opposite edges and in marginal portions on the lower side thereof adjacent to said edges (FIG. 6). The blank thus disposed onto the guide bars 56 is then moved to a place straight above the first conveyor for pulling the blank into the mould by means of a fourth conveyor (FIG. 6) comprising two endless chains 58, which are coupled with the mentioned second chain 47 and are each provided with a carrier member 57.

The third conveyor 54, 55 is freely pivotable about the common shaft 53 of the sprocket wheels of the interconnected endless chains 47 and 58 and it is attached through a tail member 59 and a rod 60 to a block 61 which is also freely pivotable about the shaft 53. Said block 61 is provided with operating arms 64 and 65 adapted to be brought into the path of two carrier members 62 and 63 of the chain 47. In the state shown in FIG. 4 the carrier members 57 are in the left-hand end position and a blank 3 is disposed onto the guide bars 56 by the third conveyor 54, 55. If the carrier members 57 are moved to the right in order to place the blank straight above the first conveyor 17, 18, 19, 20 the carrier member 62 is also moved to the right, but the carrier member 63 is moved to the left (FIG. 6). In that case the carrier member 63 is passed through a recess 67 provided in the arm 65 and bridged by a weak leaf spring 66 without taking said arm along. During the return stroke of the chains 47 and 58 the carrier member 62 is moved to the left and the carrier member 63 is moved to the right (see the arrows 68, 69 in FIG. 6). Then, however, the carrier member 63 bumps against the leaf spring 66, so that the arms 65, 64 and the conveyor 54, 55 are pushed upwardly thereby and the suction cups 55 are forced against the lowermost blank 3 contained in the magazine 52. In the end portion of the path of the carrier member 62 the arm 64 is swung into a position within the reach of the latter member (see the position of the arm 64 shown in dotted lines in FIG. 5). After the conveyor 54, 55 has been swung upwardly the carrier member 63 can be moved whilst passing under the arm 65 to its end position shown in FIG. 4. However, as soon as the carrier member 62 contacts the upwardly swung arm 64 the conveyor 54, 55, the blank sucked thereto and the arms 64, 65 are forced downwardly by the carrier member 62 and a next blank is disposed onto the guide bars 56.

Before the blank is folded the load for the box may be disposed onto the bottom portion thereof. In the apparatus illustrated in FIGS. 4 and 5 the box is filled with a single layer of bottles or tins 70. These bottles or tins are supplied by a conveyor belt 71 and pushed by a pushing member 72 onto the blank lying in its place straight above the first conveyor (FIGS. 4, 5). The pushing member 72 is attached to an endless chain 73 mounted for reciprocation between two end positions and passed over a sprocket wheel 74 which is fixed on the shaft of the sprocket wheels 48, 49 of the chains 47 and 50. Consequently, the pushing member is reciprocated synchronously with the four conveyors described hereinbefore. The diameters of the sprocket wheels 48, 49 and 74 define the ratio between the stroke of the first conveyor, the one of the pushing member and those of the second conveyor and the carrier members 57 of the fourth conveyor, whereas the ratio between the strokes of the two last mentioned conveyors is determined by the diameters of the sprocket wheels fixed on the shaft 53.

It is observed, that, should the boxes have to be filled with layers of articles, e.g. layers of shallow cups, the pushing member 72 will have to push each time a layer of articles which may be placed in advance on a sheet of board onto the layer or layers of articles already disposed on the blank, after the first conveyor 17, 18, 19, 20 has been lowered through the height of one layer. This requires between the conveyors and the pushing member the provision of a driving mechanism which drives the first conveyor stepwise downwardly, that means each time through the height of a layer of articles.

A particular feature of the described embodiments of the apparatus according to the invention is, that one set of folding members 12, 13, 14, 15, 36, 37, 38, 39, walls of the magazine 2 or 52 and suction cups 20 with accessories of the first conveyor 17, 18, 19, 20, and also one supporting strip 22 and one guide bar 56 are attached to a stationary part whereas the other set of corresponding members, the other supporting strip 22 and the other guide bar 56 are attached to a movable part of the apparatus mounted for adjustment, for instance by means of a threaded rod with a hand wheel, in a direction transverse to the direction of movement of the second conveyor and parallel to the plane of the path thereof. Furthermore, the folding members 15 and the carrier members 57 of the chains 58 are mounted for adjustment in the direction of movement of the second conveyor and the folding fingers 36 are adjustable in the direction of movement of the first conveyor. In that way the apparatus is easily adaptable to the dimensions of the boxes to be folded. The stroke of the pushing member 72 can be adapted by selection of the diameter of the sprocket wheel 74. If necessary, the third conveyor 54, 55 may be slidably mounted on the shaft for its adjustment. It has appeared, that mostly it is not necessary that one of the chains 58 with its carrier member 57 is also mounted for adjustment in the transverse direction referred to.

It is also observed that, although in the description hereabove horizontal and vertical directions are mentioned, the apparatuses may also be used in other positions, for instance in a horizontal instead of the shown vertical position.

I claim:

1. Apparatus for folding a box or trough from a preformed blank having folding seams, which comprises the combination of means for holding a blank in a predetermined position; a mold assembly spaced from said predetermined position and including a set of folding members and a support; first conveyor means for reciprocation between a retracted position adjacent said support and an extended postion adjacent said predetermined position and for picking up a blank at said predetermined position and conveying it past said set of folding members and onto said support so that the blank is placed in the mold in at least partially folded condition; second conveyor means for reciprocation between said support and a laterally displaced position with respect thereto and for conveying the folded blank to the laterally displaced position; and drive means for synchronously reciprocating said first and second conveyor means, said drive means comprising a first endless chain having generally parallel flights, a further endless chain having at least one flight generally parallel to a flight of the first endlesss chain and being longer than either flight of the first endless chain, a motor driving said first endless chain unidirectionally, link means pivotally joining said first endless chain to said one flight of the further endless chain so that the one flight of the further endless chain is travelled in one direction when the link means is moving along one flight of the first endless chain and in the opposite direction when the link means is moving along the other flight of the first endless chain, and transmission means connected with said further endless chain for reciprocating one of said conveyor means at a selected drive ratio relative to reciprocation of the other conveyor means.

2. Apparatus as defined in claim 1 wherein said drive means also includes a third endless chain having one flight generally parallel to the path of reciprocation of one of the conveyor means, said transmission means interconnecting said further endless chain and said third endless chain.

3. Apparatus as defined in claim 2 wherein said transmission means comprises a set of sprocket wheels, one in engagement with said further endless chain and the other in engagement with said third endless chain.

4. Apparatus as defined in claim 2 wherein the flights of said first endless chain and said further endless chain extend in directions which are substantially orthogonal to the flights of said third endless chain.

5. Apparatus as defined in claim 1 wherein the second conveyor means includes a carrier member movably connected with the second conveyor means for movement into an active position when the second conveyor means moves toward said laterally displaced position and into an inactive position when the second conveyor means moves toward said support.

6. Apparatus as defined in claim 5 including a second set of folding members positioned in the path of a folded blank between said support and said laterally displaced position, said second conveyor means having suction cup means for engaging the leading bottom margin of the folded blank as it moves toward said laterally displaced position and adapted to hold the folded blank during transport through said second set of folding members.

7. Apparatus as defined in claim 1 wherein said set of folding members comprises two groups thereof, one of the groups being connected to a stationary part of the apparatus and the other group being movable in the direction parallel and transverse to the path of the second conveyor means.

8. Apparatus as defined in claim 1 including third conveyor means for feeding blanks individually to a position spaced from said predetermined position, and fourth conveyor means for transporting an individual blank to said predetermined position, said third and fourth conveyor means being synchronously driven by said further endless chain.

9. Apparatus as defined in claim 8 including feeding means for feeding goods onto a blank when it is in said predetermined position thereof, said transmission means connecting said feeding means to said further endless chain in selected drive ratio relative thereto.

10. Apparatus as defined in claim 6 wherein both sets of folding members comprise two groups thereof, one of the groups of each set being connected to a stationary part of the apparatus and the other group of each set being movable in the direction parallel and transverse to the path of the second conveyor means.

11. Apparatus for folding a box or trough from a preformed blank having folding seams, which comprises the combination of means for holding a blank in a predetermined position; a mold assembly spaced from said predetermined position and including a set of folding members and a support; first conveyor means for reciprocation between a retracted position adjacent said support and an extended postion adjacent said predetermined position and for picking up a blank at said predetermined position and conveying it past said set of folding members and onto said support so that the blank is placed in the mold in at least partially folded condition; second conveyor means for reciprocation between said support and a laterally displaced position with respect thereto and for conveying the folded blank to the laterally displaced position; further conveyor means for transporting an individual blank to said predetermined position; and drive means for synchronously reciprocating said first, second and further conveyor means, said drive means comprising a first endless chain having spaced flights parallel to the path of said second conveyor means, a further endless chain having a lower flight generally parallel to a flight of the first endless chain and parallel to the path of the further conveyor means, said lower flight being longer than either flight of the first endless chain, a motor driving said first endless chain unidirectionally, link means forming part of said second conveyor means and pivotally joining said first endless chain to said lower flight of the further endless chain so that said lower flight is travelled in one direction when the link means is moving along one flight of the first endless chain and in the opposite direction when the link means is moving along the other flight of the first endless chain, and transmission means connected with said further endless chain for reciprocating said second and further conveyor means at a selected drive ratio relative to reciprocation of the first conveyor means.

12. Apparatus for folding a box or trough from a preformed blank having folding seams, which comprises the combination of means for holding a blank in a predetermined position; a mold assembly spaced from said predetermined position and including a set of folding members and a support; a generally L-shaped disposition of conveyor means comprising first conveyor means for reciprocation between a retracted position adjacent said support and an extended postion adjacent said predetermined position and for picking up a blank at said predetermined position and conveying it past said set of folding members and onto said support so that the blank is placed in the mold in at least partially folded condition; second conveyor means for reciprocation between said support and a laterally displaced position with respect thereto and for conveying the folded blank to the laterally displaced position; and drive means for synchronously reciprocating said conveyor means, said drive means comprising a first endless chain having spaced flights parallel to the path of said second conveyor means, a further endless chain having one flight generally parallel to a flight of the first endless chain, said one flight being longer than either flight of the first endless chain, a motor driving said first endless chain unidirectionally, link means pivotally joining said first endless chain to said second conveyor means and to said one flight of the further endless chain so that said one flight is travelled in one direction when the link means is moving along one flight of the first endless chain and in the opposite direction when the link means is moving along the other flight of the first endless chain, a third endless chain having flights parallel to the path of the first conveyor means, second link means connecting said first conveyor means to said third endless chain, and transmission means connecting said further endless chain to said third endless chain for reciprocating said conveyor means at a selected relative drive ratio.

13. Apparatus as defined in claim 12 including third conveyor means for feeding a blank to said predetermined position along a path parallel to the path of the second conveyor means, said third conveyor means comprising pusher members connected to a flight of said further endless chain.

14. Apparatus as defined in claim 13 including fourth conveyor means for feeding individual blanks to the third conveyor means, said fourth conveyor means comprising a swingable member, and intermittent drive means between said swingable member and said further endless chain.

15. Apparatus as defined in claim 14 including feeding means for feeding contents onto a blank at said predetermined position, said feeding means bieng connected to said further endless chain and said third endless chain by said transmission means for selected drive ratio both with respect to the first conveyor means and the second conveyor means.

* * * * *